US009581392B2

(12) United States Patent
Niimi et al.

(10) Patent No.: US 9,581,392 B2
(45) Date of Patent: Feb. 28, 2017

(54) ARRANGEMENT FOR COOLING A PLASMA-BASED RADIATION SOURCE WITH A METAL COOLING LIQUID AND METHOD FOR STARTING UP A COOLING ARRANGEMENT OF THIS TYPE

(71) Applicant: USHIO Denki Kabushiki Kaisha, Tokyo-to (JP)

(72) Inventors: Gota Niimi, Shizuoka-ken (JP); Dominik Marcel Vaudrevange, Aachen (DE); Ralf Gordon Conrads, Kempen (DE); Maghiel Jan Kole, San Jose, CA (US)

(73) Assignee: USHIO Denki Kabushiki Kaisha, Tokyo-to (JP)

( * ) Notice: Subject to any disclaimer, the term of this patent is extended or adjusted under 35 U.S.C. 154(b) by 208 days.

(21) Appl. No.: 14/633,420

(22) Filed: Feb. 27, 2015

(65) Prior Publication Data

US 2015/0247679 A1 Sep. 3, 2015

(30) Foreign Application Priority Data

Feb. 28, 2014 (DE) ..... 10 2014 102 720

(51) Int. Cl.

| | |
|---|---|
| ***F28D 15/00*** | (2006.01) |
| ***F28F 23/00*** | (2006.01) |
| ***H05G 2/00*** | (2006.01) |

(52) U.S. Cl.

CPC ..... *F28D 15/00* (2013.01); *F28F 23/00* (2013.01); *H05G 2/001* (2013.01); *H05G 2/005* (2013.01)

(58) Field of Classification Search

USPC ..... 250/504 R, 493.1; 378/130, 141

See application file for complete search history.

(56) References Cited

U.S. PATENT DOCUMENTS

2006/0158126 A1* 7/2006 Schuermann ..... G03F 7/70908 315/111.21
2007/0090304 A1* 4/2007 Jonkers ..... H05G 2/003 250/504 R

FOREIGN PATENT DOCUMENTS

| | | | |
|---|---|---|---|
| DE | 102005023060 | A1 | 11/2006 |
| DE | 102006041863 | A1 | 3/2008 |
| DE | 112005001190 | B4 | 2/2014 |
| DE | 102013103668 | A1 | 10/2014 |

* cited by examiner

*Primary Examiner* — Kiet T Nguyen

(74) *Attorney, Agent, or Firm* — Patentbar International, P.C.

(57) ABSTRACT

An arrangement for cooling a plasma-based radiation source with a metal cooling liquid and a method for starting up a cooling arrangement of this type has a pump unit for conveying the metal cooling liquid from a reservoir to an immersion bath in a pipe portion that is connected to the reservoir in the conveying direction of the cooling circuit has at least one pump for conveying the metal cooling liquid through an external field effect of the at least one pump. A control unit for controlling the at least one pump controls the at least one pump at least temporarily in a pumping direction opposite to the conveying direction of the cooling circuit in order to generate a heating effect through external field effect on metal cooling liquid located in the pipe portion.

20 Claims, 6 Drawing Sheets

ARRANGEMENT FOR COOLING A PLASMA-BASED RADIATION SOURCE WITH A METAL COOLING LIQUID AND METHOD FOR STARTING UP A COOLING ARRANGEMENT OF THIS TYPE

RELATED APPLICATIONS

This application claims priority to German Patent Application No. DE 10 2014 102 720.5, filed Feb. 28, 2014 which is incorporated herein by reference in its entirety.

FIELD OF THE INVENTION

The invention is directed to an arrangement for cooling a plasma-based radiation source with a metal cooling liquid and method for starting up a cooling arrangement of this type. It is preferably applied for short-wavelength radiation sources for lithographic production of integrated circuits, particularly for radiation sources in the extreme ultraviolet (EUV) spectral region based on a discharge plasma.

BACKGROUND OF THE INVENTION

In short-wavelength emitting radiation sources, e.g., EUV radiation sources, the elements involved in the generation of the plasma which are heated to a very high degree by the plasma generation are cooled with a metal cooling liquid in the form of a molten metal.

Cooling circuits with molten metal are already known for a variety of applications such as the cooling of high-output circuits, nuclear reactors or radiation sources for the X-ray range.

Metals coming under consideration for metal cooling liquid are, for example, lithium, gallium, gadolinium, tin or alloys thereof having similar characteristics. Metal cooling liquid has the advantage of very good heat conductivity and, further, has electromagnetic properties so that the pumps that are required for generating a flow of cooling liquid can be realized in a compact manner without moving parts and outside the flow of cooling liquid.

Electromagnetic induction pumps are particularly suitable for this purpose. A closed flow vessel, e.g., a pipe, guiding the metal cooling liquid can be surrounded from the outside with these electromagnetic induction pumps, and the metal cooling liquid can be moved in the flow vessel, for example, through inductive action.

An arrangement for handling a liquid metal in a cooling circuit for cooling a plasma-based radiation source is disclosed in the not-prior-published DE 10 2013 103 668, where a revolving element involved in the plasma generation is cooled by the metal cooling liquid. To this end, the metal cooling liquid is moved in a cooling circuit, wherein a highly heated revolving element is at least partially immersed in an immersion bath with metal cooling liquid. The cooling circuit is completed by a reservoir in which the majority of the metal cooling liquid is received and a heat exchanger by which the metal cooling liquid can be tempered (i.e., cooled or heated). At least between the reservoir and the heat exchanger, there is a pipe connection at which are arranged pumping means which propel the metal cooling liquid through the cooling circuit.

During quasi-continuous (pulsed) operation of the radiation source, the entirety of the metal cooling liquid located in the cooling circuit is constantly kept at temperatures above the melting temperature of the metal used as cooling liquid by the—more or less continuous—injection of heat by the revolving element. In order to maintain the cooling effect in continuous operation, the increasingly heated metal cooling liquid runs through a heat exchanger incorporated in a secondary cooling circuit before being supplied again to the revolving element.

However, when the plasma generation of the radiation source is interrupted for some time there is no injection of heat. During these times, it may be necessary to keep the metal cooling liquid at temperatures above the melting temperature of the metal by means of additional heating. To this end, the reservoir is provided with a heater for heating the metal cooling liquid.

If the plasma-based radiation source is taken out of operation completely, the metal cooling liquid in the cooling circuit solidifies. Before restarting the plasma-based radiation source, the solidified metal cooling liquid must first be brought to the liquid state again. For this purpose in the above-cited DE 10 2013 103 668, in addition to the heater provided in the reservoir with which the solidified metal cooling liquid can be melted again proceeding from the reservoir, the heat exchanger (referred to therein as tempering unit) can also be used so that the metal cooling liquid can be melted by heating at two locations.

However, during the melting in the vessels of the cooling circuit it must be taken into account that the solidified metal cooling liquid expands considerably during heating before liquefying. In order not to damage the cooling circuit in this way, special constructional steps are required and a determined time regime must be maintained during melting, which makes the startup of the metal cooling liquid circulation time-consuming, or heating elements must be arranged at all possible parts of the vessel, including all of the pipe connections.

SUMMARY OF THE INVENTION

It is the object of the invention to find a novel possibility for cooling components of a plasma-based radiation source by means of a metal cooling liquid which achieves a fast but risk-free melting of the solidified metal cooling liquid in a cooling circuit without needing to arrange heating elements at all vessel parts and pipelines.

In an arrangement for cooling a plasma-based radiation source with a metal cooling liquid comprising a revolving element which is to be cooled and which takes part in the plasma generation, an immersion bath which contains the metal cooling liquid in which the revolving element is at least partially immersed, a cooling circuit which is connected to the immersion bath and which has a reservoir for receiving a minimum volume of the metal cooling liquid, means for tempering the metal cooling liquid above a melting temperature, at least one temperature sensor for monitoring the temperature of the metal cooling liquid and a pump unit for circulating the metal cooling liquid in the cooling circuit, the above-stated object is met in that the pump unit for conveying the metal cooling liquid from the reservoir to the immersion bath is arranged in a pipe portion that is connected to the reservoir in the conveying direction of the cooling circuit, in that the pump unit has at least one pump in the pipe portion for conveying the metal cooling liquid through an external field effect of the at least one pump, and in that a control unit is provided for controlling the at least one pump, with which control unit the at least one pump can be operated at least temporarily in a pumping direction opposite to the conveying direction of the cooling circuit in order to generate a heating effect on metal cooling liquid located in the pipe portion against a flow resistance of the metal cooling liquid in the pipe portion through the persistent external field effect.

The at least one pump is advantageously arranged at a pipe portion of the cooling circuit that is disposed below a minimum fill level which is predetermined by the minimum volume of the cooling liquid in the reservoir. The flow resistance of the cooling liquid in the pipe portion is generated by cooling liquid stored in the reservoir.

The pump unit advisably has at least a first pump and at least a second pump, which second pump is arranged in each instance in the pipe portion upstream of the first pump from the direction of the reservoir.

The flow resistance in the pipe portion is preferably generated by means of the second pump operated in the conveying direction when the first pump is controlled opposite to the conveying direction of the cooling circuit.

Further first pumps and second pumps are provided in the pump unit and are controllable separately by the control unit such that at least all of the first pumps can be operated with pumping direction directed opposite to the conveying direction.

All of the pumps contained in the pump unit are induction pumps.

The control unit is advantageously provided for monitoring and adjusting an operating temperature of the metal cooling liquid above the melting temperature thereof, and by means of the at least one temperature sensor provided in the cooling circuit the control unit initiates a heating mode when the temperature drops below the required operating temperature of the metal cooling liquid and initiates a cooling mode when the required operating temperature is exceeded.

In addition to the operation of the at least one pump opposite to the conveying direction, a heater can be switched on by means of the control unit in heating mode to heat the metal cooling liquid in the reservoir.

At least one heat exchanger arranged upstream of the immersion bath is advisably switched on by means of the control unit in the cooling mode for cooling the metal cooling liquid to temperatures below a determined maximum operating temperature of the metal cooling liquid and can be controlled such that the heat exchanger maintains a determined minimum operating temperature above the melting temperature of the metal cooling liquid during cooling.

In a further advantageous arrangement, the heat exchanger can be switched on as heater when the temperature of the metal cooling liquid is below the melting temperature or threatens to fall below the determined minimum operating temperature, and the heat exchanger contains a secondary cooling circuit with a coolant which has a minimum temperature above the melting temperature of the metal cooling liquid.

The reservoir advisably has a cross section which increases toward the top and in which the heater is arranged so as to dip into the metal cooling liquid from above.

The heater is preferably divided into separate heating circuits which can be controlled separately for melting the metal cooling liquid in the reservoir by layers from top to bottom.

The immersion bath advisably has its own further heater.

In a method for starting up a cooling arrangement of a plasma-based radiation source with a metal cooling liquid which must be changed from a solid state to a liquid state for purposes of circulating in a cooling circuit, the above-stated object is further met through the following steps:

melting the metal cooling liquid which is solidified in a reservoir of the cooling circuit through heating by means of a heater starting from a maximum fill level of the metal cooling liquid in direction of a deepest point of the reservoir, melting the metal cooling liquid which is solidified in a pipe portion connected to the reservoir by means of at least one pump which is arranged in the pipe portion and which is based on external field effect and which is temporarily operated during the melting in a pumping direction opposite to a predefined conveying direction of the cooling circuit, and heating the entire cooling circuit to an operating temperature above the melting temperature of the metal cooling liquid by conveying the metal cooling liquid out of the reservoir into the cooling circuit by means of the at least one pump arranged in the pipe portion, wherein switching to the predefined conveying direction of the cooling circuit is carried out.

A pump which is temporarily operated opposite to the conveying direction of the cooling circuit for heating purposes for melting the metal cooling liquid is advantageously adjusted to a maximum flow rate.

The switching of at least one pump from a pumping direction temporarily directed opposite to the conveying direction into the conveying direction of the cooling circuit is advisably carried out when a required operating temperature of 5-70 K above the melting temperature of the metal cooling liquid is reached in the pipe portion connected to the reservoir.

The at least one pump which is temporarily operated opposite to the conveying direction is preferably adjusted to a minimum flow rate for cooling purposes in conveying direction of the cooling circuit in the cooling circuit, at which minimum flow rate a predetermined operating temperature of the metal cooling liquid in the cooling circuit is achieved.

In a preferred embodiment, the melting of the metal cooling liquid which is solidified in the pipe portion connected to the reservoir takes place by pumping a first pump operated opposite to the conveying direction against a second pump which is adjusted to a maximum flow rate in conveying direction of the cooling circuit during melting.

The second pump which is operated in conveying direction of the cooling circuit is advisably adjusted to a minimum flow rate simultaneous with the switching of the first pump into the conveying direction of the cooling circuit, at which minimum flow rate a predetermined operating temperature of the metal cooling liquid in the cooling circuit is achieved.

A fast, risk-free melting of the solidified metal cooling liquid in a cooling circuit is made possible by the invention without needing to arrange additional heating elements at all of the pipelines. Further, it is possible to realize the complete melting of the solidified metal cooling liquid in a short time when (re-)starting in that temperature measurements log the melt condition before the circulation of cooling liquid in the cooling circuit.

BRIEF DESCRIPTION OF THE DRAWINGS

The invention will be described in the following with reference to embodiment examples. The accompanying drawings show.

DETAILED DESCRIPTION OF THE PREFERRED EMBODIMENTS

A cooling circuit 1 for cooling a revolving element 31 of a plasma-based radiation source which directly participates in a plasma generation and which is highly heated by the energy supplied for generating the plasma and by the plasma itself which emits a radiation and particles has a metal cooling liquid 2 for efficient cooling.

Figure 1:
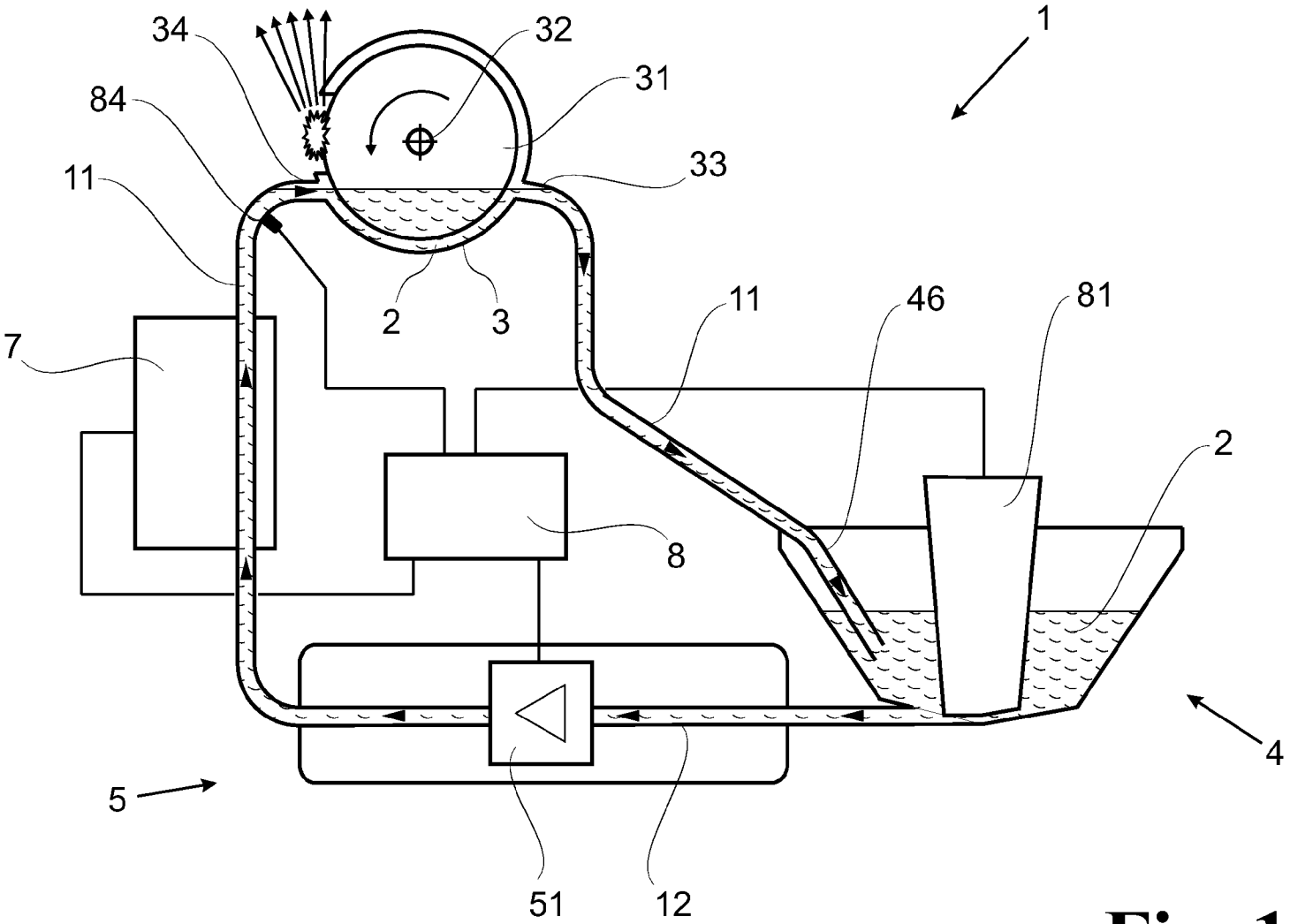
FIG. 1 is a schematic diagram of a cooling circuit of an operating plasma-based radiation source for cooling a revolving element with a metal cooling liquid.

According to FIG. 1, the cooling circuit 1 comprises an immersion bath 3 with the metal cooling liquid 2 in which the revolving element 31 is at least partially immersed, a reservoir 4 for supplying (storing) a sufficient amount of the metal cooling liquid 2 which—when it is used at the same time as an emitter material for the plasma generation—is exposed to a certain amount of wear, a heat exchanger 7 for cooling the metal cooling liquid 2 and a heater 81 for heating the metal cooling liquid 2, a pump unit 5 with at least a first pump 51 for circulating the metal cooling liquid 2 in the cooling circuit 1, at least one temperature sensor 84 for monitoring the temperature of the metal cooling liquid 2 and a control unit 8 for controlling the tempering of the metal cooling liquid 2 to a minimum operating temperature moderately above the melting temperature thereof. The reservoir 4, the at least one first pump 51, the heat exchanger 7 and the immersion bath 3 are connected via a pipeline 11 for guiding the cooling circuit 1.

Pure tin with a melting point of 232° C. is preferably used as suitable emitter material and as metal cooling liquid 2. The minimum operating temperature can then be adjusted to 240° C. so that at least a difference of 8 kelvin is maintained relative to the melting point. In principle, any other material with similar physical properties which is suitable for plasma generation can also be used.

The revolving element 31 of the plasma-based radiation source is a substantially vertically oriented circular disk which is supported so as to rotate around an axis of rotation 32 extending through the center point thereof. The revolving element 31 is fastened with respect to the immersion bath 3 such that a peripheral edge area dips into the metal cooling liquid 2 in the immersion bath 3 and this edge region is coated with the metal cooling liquid 2 during the rotation of the revolving element 31.

The immersion bath 3 is a vessel which is open at the top and in which approximately 2-10% of all of the metal cooling liquid 2 present in the cooling circuit 1 is received during operation of the plasma-based radiation source in order to wet the revolving element 31 with the metal cooling liquid 2 and cool it. The immersion bath 3 is dimensioned corresponding to the size of the revolving element 31 so as to ensure that the revolving element 31 is immersed in the metal cooling liquid 2 sufficiently for cooling. The immersion bath 3 forms a highest point in the cooling circuit 1 and is connected to a return 46 of the reservoir 4 via an outlet 33.

The reservoir 4 is arranged at a lower point in the cooling circuit 1 than the immersion bath 3 and is shaped as a vessel with a cross section which widens toward the top. A majority of all of the metal cooling liquid 2 present in the cooling circuit 1 is received in the reservoir 4. The metal cooling liquid 2 is pumped from the reservoir 4 to the immersion bath 3 in a conveying direction of the cooling circuit 1. To this end, the first pump 51 is arranged in a pipe portion 12 of the pipeline 11 following the reservoir 4 in conveying direction.

Figure 2:
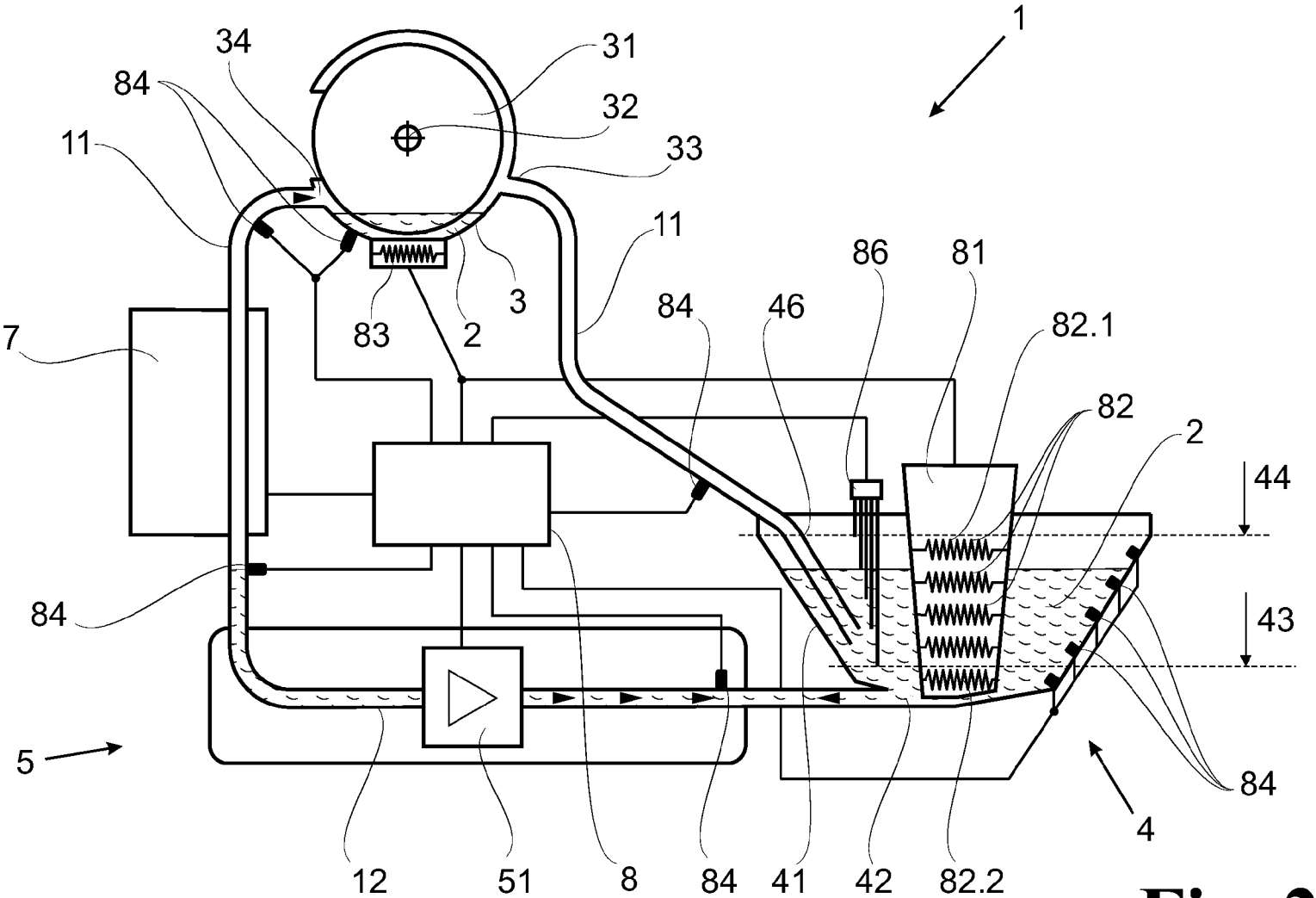
FIG. 2 is a schematic diagram of a cooling circuit of a plasma-based radiation source to be put into operation.

As is shown in FIG. 2, the reservoir preferably has a plurality of temperature sensors 84 which are arranged inside the reservoir 4 at different heights at a vessel wall 41 which defines the cross section of the reservoir 4.

The heater 81 is arranged so as to be immersed from above as centrally as possible in the reservoir 4 and in the metal cooling liquid 2 received therein and is preferably divided into a plurality of heating circuits 82 positioned one above the other. A first heating circuit 82.1 is arranged in the region of a maximum fill level 44 and a final heating circuit 82.2 is arranged near a vessel bottom of the reservoir 4 below a minimum fill level 43 of the metal cooling liquid 2 in the reservoir 4.

The reservoir 4 is connected to the at least one first pump 51 of the pump unit 5 via the pipe portion 12 of the pipeline 11 which is connected to a removal orifice 42 at a lowest point of the reservoir 4. The first pump 51 is arranged in the cooling circuit 1 below the minimum fill level 43 of the metal cooling liquid 2 in the reservoir 4. This ensures that the first pump 51 is always filled with the metal cooling liquid 2 so that a pumping action is ensured.

An electromagnetic induction pump which acts on the metal cooling liquid 2 exclusively through an external field effect and which operates without mechanically moving parts is preferably used as first pump 51.

Downstream of the first pump 51 in the cooling circuit 1, the pipeline 11 is connected to the heat exchanger 7 through which heat can be extracted from the metal cooling liquid 2. Following the heat exchanger 7, the pipeline 11 is connected to an inlet 34 to the immersion bath 3. The portion of the pipeline 11 following the outlet 33 of the immersion bath 3 opens into the return 46 of the reservoir 4 which closes the cooling circuit 1.

As a result of an inherently low efficiency of the plasma-based radiation sources of less than 2%, a large proportion of energy expended in plasma generation is converted into heat. Therefore, the cooling circuit 1 is primarily designed to dissipate these enormous amounts of heat as waste heat and to extract the heat from the cooling circuit 1 very efficiently. On the other hand, when a plasma-based radiation source is operated intermittently (burst regime), the temperature of the metal cooling liquid 2 must always be kept above the melting temperature of the metal used in the cooling circuit 1 so that the metal cooling liquid 2 is in liquid state also in case the temperature of the cooling circuit 1 is drastically reduced due to the absence of heat injection.

The injection of waste heat occurring during plasma generation into the metal cooling liquid 2 takes place through the revolving element 31 involved in the plasma generation. The revolving element 31 rotates around its axis of rotation 32. During the rotation, it initially comes in contact with the metal cooling liquid 2 at inlet 34 and subsequently dips into the immersion bath 3 located below it with a portion of its outer circumference. The waste heat can be dissipated at the metal cooling liquid 2 and the revolving element 31 can be cooled.

The volume of the immersion bath 3 for receiving the metal cooling liquid 2 is formed as a channel which curves with the radius of the revolving element 31 and which increases the heat exchanger volume, while the immersion depth of the revolving element 31 measured from the outer circumference is kept small, and which is closed radially in direction of the axis of rotation 32 with the exception of a remaining slit for guiding through the revolving element 31. Only a very small proportion, approximately 2-3%, of all of the metal cooling liquid 2 present in the cooling circuit 1 is received in an immersion bath 3 in this special configuration.

To maintain the cooling effect of the immersion bath 3, this small proportion is continuously circulated through the first pump 51 which circulates the cooling circuit 1. The exchange and, therefore, a required flow rate of the first pump 51 are monitored by the control unit 8. The flow rate is adapted by the control unit 8 such that the temperature of the metal cooling liquid 2 in the immersion bath 3 is kept at the most optimal possible operating temperature. The adaptation of the flow rate is carried out by adjusting a frequency of a supply voltage used for the operation of the at least one first pump 51.

In addition to the operation of the first pump 51, the metal cooling liquid 2 is also transported and circulated by means of the rotation of the revolving element 31 through the immersion bath 3. After the immersion bath 3, the metal cooling liquid 2 is propelled by gravity force to run back to the return 46 of the reservoir 4 via the pipeline 11 connected to the outlet 33.

In connection with the flow rate, a required fill level is also maintained in the immersion bath 3, at which fill level the revolving element 31 is immersed by 5-50% of its radius, preferably 10-20%, in the metal cooling liquid 2. An immersion depth of about 3 cm is sufficient for radii of about 20 cm for efficient cooling. However, the immersion depth can be further reduced as the diameter of the revolving element 31 increases. A maximum possible fill level of the immersion bath 3 is limited by the position of the outlet 33 at the immersion bath 3.

The highly heated metal cooling liquid 2 flowing out via the pipeline 11 is collected in the reservoir 4 situated at a lower point. The majority of all of the metal cooling liquid 2 present in the cooling circuit 1 is received in the reservoir 4 as a reserve. A first cooling is achieved already in the reservoir 4 in that the heated metal cooling liquid 2 conveyed from the immersion bath 3 mixes with the cooler metal cooling liquid 2 present in the reservoir 4.

The reservoir 4 has a fill level sensor 86 by which the control unit 8 can monitor the fill level of the metal cooling liquid 2. The fill level sensor 86 has means for detecting the minimum fill level 43, the maximum fill level 44 and intermediate levels which are preferably oriented corresponding to the position of the heating circuits 82.

The minimum fill level 43 of the reservoir 4 is defined by the least amount of metal cooling liquid 2 required to fill the first pump 51 in pipe portion 12 such that delivery and circulation of the metal cooling liquid 2 in the cooling circuit 1 is made possible and can be maintained. The control unit 8 generates a warning when the fill level falls below the minimum fill level 43.

In an operating plasma-based radiation source in which no plasma generation takes place over a longer period of time, the metal cooling liquid 2 may cool down to below the melting temperature of the metal as a result of the fact that no waste heat is being injected. To prevent solidification, the metal cooling liquid 2 in the reservoir 4 can be heated with the heater 81. The heater 81 dipping into the reservoir 4 from above heats the metal cooling liquid 2 surrounding it. The heated metal cooling liquid 2 is then circulated by the first pump 51 in the entire cooling circuit 1. The control unit 8 is also used to regulate the heater 81 and constantly monitors the minimum operating temperature of the metal cooling liquid 2 with a further temperature sensor 84 arranged at the return 46 of the reservoir 4. The return 46 is at the greatest distance from the heater 81 in the cooling circuit 1. The temperature measured at this location must therefore always be above the melting temperature of the metal used as metal cooling liquid 2 in order to prevent blockage of the cooling circuit 1 by solidified metal cooling liquid 2.

When the plasma-based radiation source is taken out of operation, the metal cooling liquid 2, as is shown in FIG. 2, converges by force of gravity in the reservoir 4 and in the parts of the pipeline 11 lying below the current fill level of the reservoir 4 and solidifies there after completely cooling.

Since the outlet 33 in the immersion bath 3 is not located at a lowest point of the immersion bath 3, a small amount of metal cooling liquid 2 also remains there. This causes the revolving element 31 to be fixed in the solidified metal cooling liquid 2 after complete cooling. The metal cooling liquid 2 which has solidified at this location can be melted again via further heaters 83 arranged at the immersion bath 3.

Before restarting, the solidified metal cooling liquid 2 must first be melted again in the entire cooling circuit 1 and heated at least to the minimum operating temperature of the metal cooling liquid 2.

FIG. 2 shows the condition of the cooling circuit 1 of a plasma-based radiation source before being put into operation.

In plasma-based radiation sources according to the prior art, resistance wire heaters are usually used as heater 81 for heating and can be arranged inside or outside of the vessel walls 41 of the reservoir 4 and at the pipeline 11. Particularly when used at the pipeline 11 and the first pump 51 arranged at the latter, the heater 81 has considerable drawbacks.

External arrangement is slow, sluggish and inefficient because the heating would have to take place through walls of the reservoir 4, of the first pump 51 or of the pipeline 11 and the heater 81 also radiates into the surroundings. When arranged in the interior of the pipeline 11, the heater 81 is exposed to corrosion and erosion caused by the metal cooling liquid 2 and therefore to increased wear. Further, internal arrangement leads to a constriction of a usable pipeline cross section and causes additional flow resistances for the metal cooling liquid 2.

Further, when the metal cooling liquid 2 which is solidified in the cooling circuit 1 is heated, a thermal expansion must be taken into account and the heating must take place in a controlled manner such that no damage can come to the vessels of the cooling circuit 1, particularly the narrow pipeline 11.

Therefore, in order to melt metal cooling liquid 2 in the pipeline 11, an inductive heater is used instead of conventional resistance wire heaters. The operating principle of the inductive first pump 51 can be used to realize this. The heating action is achieved in that eddy current losses caused by the field effect of the induction pump lead to heating of the solidified metal cooling liquid 2 in the region of the first pump 51. In so doing, the first pump 51 is occasionally operated in a pumping direction opposite to the conveying direction of the cooling circuit 1 with maximum pumping output. FIG. 2 shows the first pump 51 in the temporary opposed pumping direction.

Figure 3:
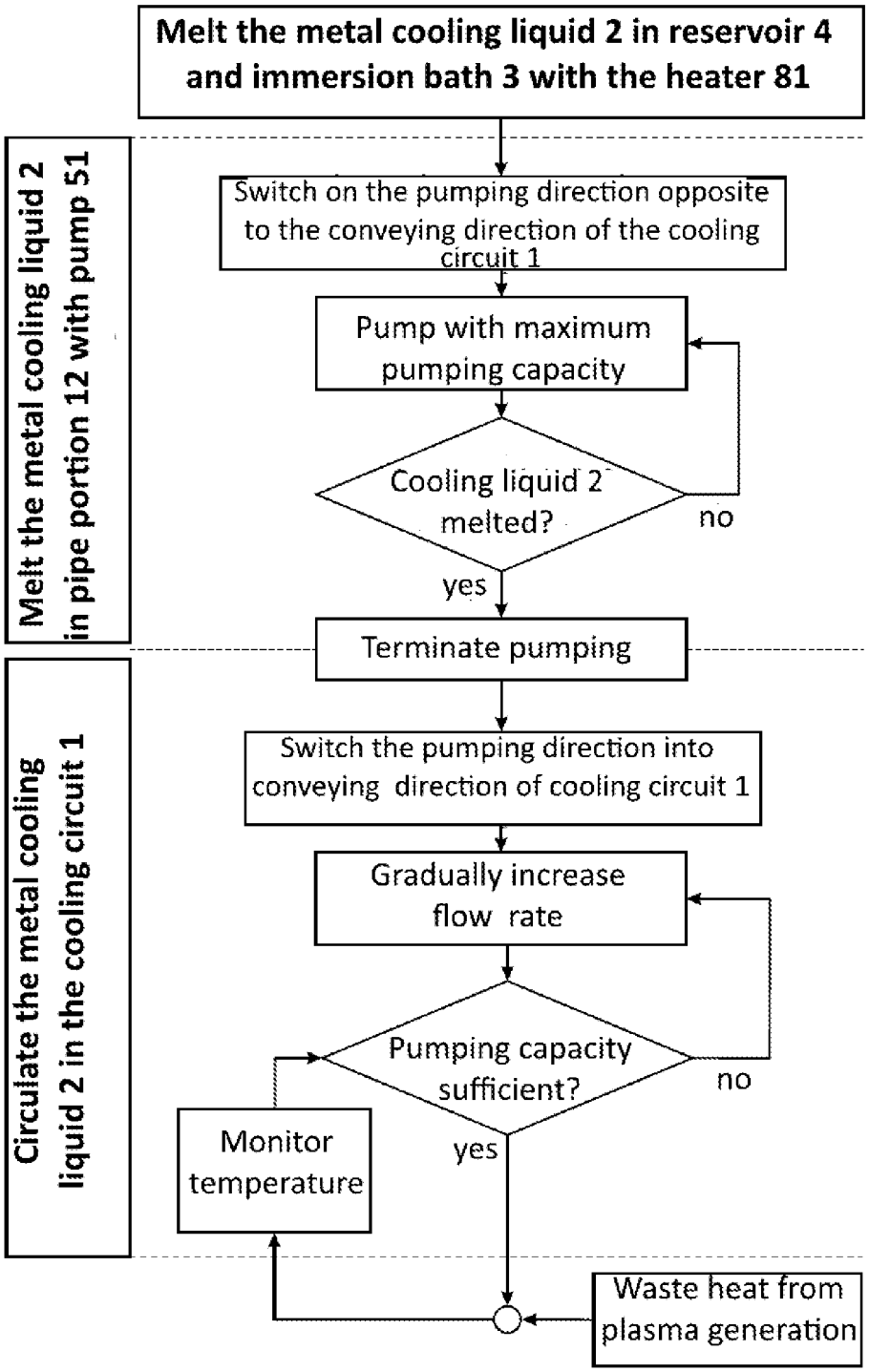
FIG. 3 is a basic process sequence for startup of a plasma-based radiation source with a metal cooling liquid.

When heating with the first pump 51, a special process sequence, shown in an overview in FIG. 3, must be adhered to. The process sequence is described in the following with reference to the use of tin as metal cooling liquid 2, but is also applicable to any other metal coolant with suitable temperature thresholds.

In a first method step, the metal cooling liquid 2 which is solidified in the reservoir 4 is first heated and melted. In order to prevent damage by thermal expansion, the melting is carried out by layers starting from the maximum fill level 44 downward in direction of the bottom of the vessel. In so doing, the reservoir 4 can additionally have a cross section which increases toward the top (e.g., as in the embodiments according to FIGS. 4 to 6 and FIG. 7) so that when a thermal expansion takes place horizontally the solidified metal cooling liquid 2 cannot encounter any counter bearing at the laterally limiting vessel walls 41.

To melt the metal cooling liquid 2 which is solidified in the reservoir 4, a heater 81 is used which is immersed in the metal cooling liquid 2. For this purpose, the heater 81 is divided into the plurality of heating circuits 82 which are located one above the other and with which the layered melting can be carried out. The heating circuits 82 can be operated independently from one another by the control unit 8. A temperature sensor 84 fastened to the vessel wall 41 of the reservoir 4 is associated with each of the heating circuits 82.

Based on the amount of metal cooling liquid 2 that has solidified in the reservoir 4 as determined by the fill level sensor 86, the control unit 8 determines the heating circuit 82 that lies at the height of the current fill level of the reservoir 4. If the determined heating circuit 82 is not the heating circuit 82 located at the height of the maximum fill level 44, the heating circuit 82 located at the current fill level is defined as first heating circuit 82.1 with which the melting is initiated. Compared with an expansion, for example, in the interior of the solidified metal cooling liquid 2, the heating metal cooling liquid 2 at the surface can expand without hindrance in any direction without causing damage.

When the optimal operating temperature of 250° C. is reached at a temperature sensor 84 associated with the first heating circuit 82.1, the control unit 8 switches on the next lowest heating circuit 82. This process is continued until a temperature of 270° C. is reached and maintained in the entire reservoir 4 after actuation of the final heating circuit 82.2 at the vessel bottom of the reservoir 4 and the metal cooling liquid 2 in its entirety is melted with certainty. This method step takes about 2 to 3 hours depending on the fill level in the reservoir 4.

The metal cooling liquid 2 solidified in the immersion bath 3 is also heated at the same time as the reservoir 4. This takes place with the further heater 83 arranged at the immersion bath 3. Due to the smaller amount of metal cooling liquid 2, the initial melting takes place substantially faster in this case than in the reservoir 4 and there is also no risk that the immersion bath 3 or the revolving element 31 will be damaged by the thermal expansion of the metal cooling liquid 2.

After the metal cooling liquid 2 is melted in the vessels, namely, the immersion bath 3 and reservoir 4, the metal cooling liquid 2 that is solidified in the pipe portion 12 of the pipeline 11 following the reservoir 4 is heated and melted in a second method step.

Heating proves more difficult in the narrow pipe portion 12 because the metal cooling liquid 2 being heated does not have the opportunity to expand in any direction but rather only one-dimensionally in direction of an axis of the pipeline 11. In order for melting to take place quickly and uniformly, the heating is carried out with a first pump 51 which is already provided in this region and which is an electromagnetic induction pump.

In a first embodiment example, in contrast to the circulation of the metal cooling liquid 2 in the cooling circuit 1 in which the first pump 51 is operated in a predefined conveying direction of the cooling circuit 1, the first pump 51 is operated in the opposite pumping direction when the plasma-based radiation source is put into operation. The change in pumping direction takes place through a phase change of the supply voltage used for operating the first pump 51. For fast melting of the metal cooling liquid 2, the first pump 51 is operated at maximum pumping capacity opposite to the conveying direction against a flow resistance of the metal cooling liquid 2 which is initially determined by the still solidified metal and, in the melting process, is either present against the hydrostatic pressure of the metal cooling liquid 2 in the reservoir 4 or is generated by the flow obstacle arranged additionally between reservoir 4 and first pump 51. As a result of eddy current losses within the immobile metal cooling liquid 2, heating of the pipe portion 12 which is enclosed by the first pump 51 is brought about in the region of the first pump 51, which leads to rapid melting. As soon as only a portion of the metal cooling liquid 2 is melted, this portion is moved through the pumping action within the pipe portion 12 in direction of the reservoir 4. Accordingly, in this basic variant the pumping action of an individual first pump 51 is directed counter to a flow resistance corresponding to the hydrostatic pressure of the metal cooling liquid 2 received in the reservoir 4. Strong turbulences which further accelerate melting are brought about in pipe portion 12 by the conveying of the partially melted metal cooling liquid 2. Expanding metal cooling liquid 2 can shunt into the reservoir 4 which has already melted previously.

Depending on the fill level of metal cooling liquid 2 in the reservoir 4, metal cooling liquid 2 which is somewhat solidified is also found in the pipeline 11 leading from the first pump 51 to the immersion bath 3. This metal cooling liquid 2 is gradually also melted during the heating of the pipe portion 12 occurring as a result of the pumping of the first pump 51 which takes place opposite to the conveying direction through heat conduction proceeding therefrom and through turbulences propagating in the pipeline 11. The melting can be monitored with a further temperature sensor 84 arranged in this region of the pipeline 11.

The pumping opposite to the conveying direction is continued at least until all of the metal cooling liquid 2 present in the pipe portion 12 between the first pump 51 and the reservoir 4 is melted. This condition is preferably determined with a further temperature sensor 84 arranged at the pipe portion 12 between the first pump 51 and the reservoir 4. Changes in the metal lattice of the metal cooling liquid 2 occurring during the transition from the solid state to the liquid state are detected with this temperature sensor 84. The change in the metal lattice is an endothermic process so that the temperature remains unchanged for a short time when the melting temperature of the metal is reached. This results in a measurable, evaluable step in the otherwise continuously increasing temperature curve which reliably indicates that the melting temperature has been reached.

After an operating temperature of 235-300° C. (which is optimal for tin) has been reached in the cooling circuit 1 at the temperature sensors 84 directly or indirectly contacting the metal cooling liquid 2, the metal cooling liquid 2 in the reservoir 4, pipe portion 12 and immersion bath 3 is completely melted with certainty. Subsequently, in a last method step, the rest of the cooling circuit 1 of the plasma-based radiation source is also heated to the optimal operating temperature.

For this purpose, the pumping opposite to the conveying direction of the cooling circuit 1 is adjusted and the first pump 51 is switched to normal operation in conveying direction. Starting with a very low flow rate of the first pump 51, the metal cooling liquid 2 is conveyed in direction of the immersion bath 3. In so doing, the liquid level of the metal cooling liquid 2 in the pipeline 11 leading to the immersion bath 3 rises slightly and gradually progressively heats the pipeline 11 in this way. When the optimal operating temperature is determined in the pipeline 11, the flow rate can be further increased. When the liquid level reaches the immersion bath 3, the latter is filled until the liquid level reaches the outlet 33 and the metal cooling liquid 2 flows back into the reservoir 4 again. The rotation of the revolving element 31 is started at the same time for transporting the metal cooling liquid 2 through the immersion bath 3. All of the vessel parts of the cooling circuit 1 are heated to the optimal operating temperature one after the other by the gradually raised liquid level.

When the optimal operating temperature is determined at all temperature sensors 84 of the cooling circuit 1, the complete heating of the cooling circuit 1 is concluded and the plasma-based radiation source can be used as intended.

For this purpose, the metal cooling liquid 2 is continuously removed from the reservoir 4 and conveyed to the immersion bath 3 by the first pump 51. The pipe portion 12 leading from the reservoir 4 to the first pump 51 is connected to the removal orifice 42 at the vessel bottom of the reservoir 4. Removal at the bottom of the vessel ensures that the metal cooling liquid 2 is free from impurities such as floating oxidation products, for example.

The flow rate of the first pump 51 is regulated by the control unit 8. The flow rate is initially at least adjusted in such a way that the metal cooling liquid 2 can reach the immersion bath 3 located at a higher point in the cooling circuit 1 than the reservoir 4. This flow rate depends on the fill level of the metal cooling liquid 2 in the reservoir 4.

Further, the flow rate is regulated as a function of the waste heat of the plasma-based radiation source and, therefore, the temperature of the metal cooling liquid 2 in the immersion bath 3. The flow rate of the first pump 51 is adapted in such a way that the temperature measured at that location by the further temperature sensor 84 remains at the optimal operating temperature as far as possible and never exceeds a maximum operating temperature (310° C. for tin). This prevents thermal damage to any components of the cooling circuit 1 contacting the metal cooling liquid 2.

Figure 4:
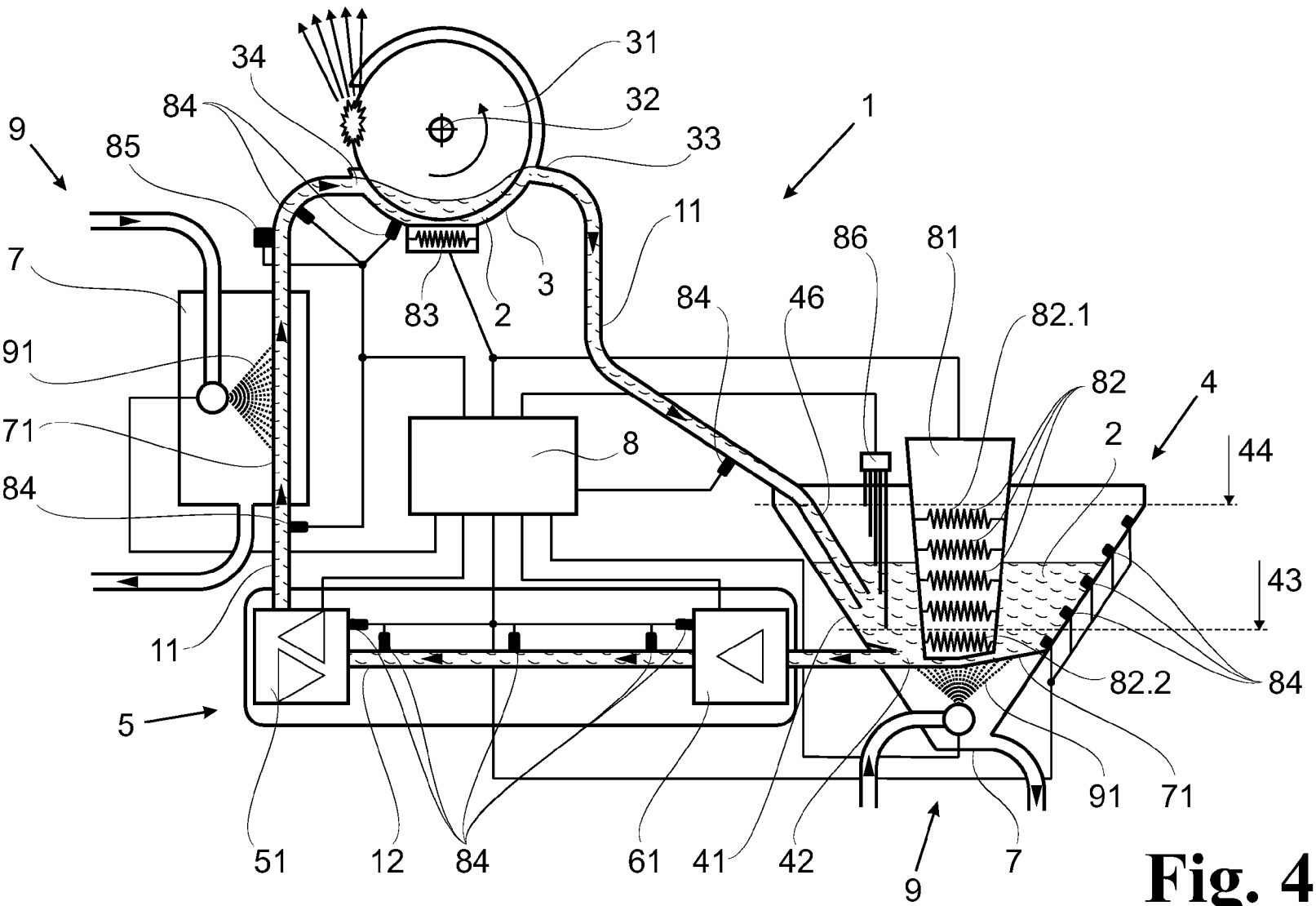
FIG. 4 is an embodiment example of a cooling circuit of a plasma-based radiation source with a heat exchanger and further temperature sensors.

In a second embodiment example shown in FIG. 4, the flow resistance required for heating the metal cooling liquid 2 in pipe portion 12 is generated through a separately controllable second pump 61. The second pump 61 is arranged between the reservoir 4 and the first pump 51 and is at a lower point in the cooling circuit 1 than the minimum fill level 43 of the metal cooling liquid 2 in the reservoir 4. The minimum fill level 43 of the reservoir 4 is defined by the least amount of metal cooling liquid 2 required to keep the second pump 61 in the pipe portion 12 filled at all times so that the conveying of the metal cooling liquid 2 into the immersion bath 3 can be constantly maintained during the pumping operation of the second pump 61. During startup of the cooling circuit 1, a distance between the first pump 51 and second pump 61 of between 0 and 20 cm is conducive to the pipe heating process. A pipe portion 12 located therebetween can preferably be 5 to 10 cm, but should not be substantially greater than 20 cm. Otherwise with greater distances, thermal insulation might be required or it could be necessary to arrange an additional heater 81 at the free pipe portion 12.

Two electromagnetic induction pumps of identical capacity (preferably identically constructed) are used for the first pump 51 and the second pump 61.

Corresponding to the process sequence in the first embodiment example, the first pump 51 is temporarily operated opposite to the conveying direction of the cooling circuit 1 during the heating mode in the second embodiment example in the second method step when the plasma-based radiation source is put (back) into operation. The second pump 61 can be operated continuously in conveying direction of the cooling circuit 1. In this example, it generates the flow resistance for the first pump 51. Accordingly, a compensation of the conveying movement of the metal cooling liquid 2 which is induced by a magnetic field through the second pump 61 is carried out with the oppositely operated first pump 51. The operation of the first pump 51 and second pump 61 at maximum flow rate leads in the region of pumps 51 and 61 to the heating of pipe portion 12 and of the initially solidified metal cooling liquid 2. As soon as only a portion of the metal cooling liquid 2 is melted, this portion is moved through the pumping action within the first pump 51 and second pump 61 and within the pipe portion 12 between pumps 51 and 61 against one another. Strong turbulences are brought about in pipe portion 12 by the opposed pumping which lead to an additional acceleration of melting. Expanding metal cooling liquid 2 can shunt into the reservoir 4 which has already melted previously.

To prevent an uncontrolled flow of the already melted metal cooling liquid 2 in direction of the immersion bath 3 before the optimal operating temperature has been reached in the entire cooling circuit 1, the second pump 61 is advantageously operated with an at least slightly lower pumping capacity than the first pump 51 so that the metal cooling liquid 2 is always moved in direction of the reservoir 4 when there is a possible difference in flow rates of the first pump 51 and second pump 61 which are preferably identically constructed.

The oppositely directed pumping is continued at least until all of the metal cooling liquid 2 in and between the pumps 51 and 61 is melted. A plurality of further temperature sensors 84 are arranged between the pumps 51 and 61 at pipe portion 12 and directly at pumps 51 and 61 for accurately monitoring this condition.

After a predetermined temperature between 235° C. and 300° C. has been reached in the cooling circuit 1 at the temperature sensors 84 which directly or indirectly contact the metal cooling liquid 2, the metal cooling liquid 2 in the cooling circuit 1 is completely melted with certainty.

Subsequently, in a last method step, the rest of the cooling circuit 1 of the plasma-based radiation source is also heated to the optimal operating temperature.

For this purpose, the pumping of the first pump 51 which is directed opposite to the conveying direction of the cooling circuit 1 is adjusted and the first pump 51 is switched to the same conveying direction as the second pump 61. Starting with a very low flow rate of the first pump 51 and second pump 61, the metal cooling liquid 2 is conveyed through the cooling circuit 1 in direction of the immersion bath 3. In this way, all of the vessel parts of cooling circuit 1 are gradually heated to the optimal operating temperature. The rotation of the revolving element 31 is started at the same time for transporting the metal cooling liquid 2 through the immersion bath 3.

When the optimal operating temperature is determined at all temperature sensors 84 of the cooling circuit 1, the complete heating of the cooling circuit 1 is concluded and the plasma-based radiation source can be used as intended. For this purpose, the metal cooling liquid 2 is removed from the reservoir 4 and continuously conveyed to the immersion bath 3 by the two pumps 51 and 61 which are operated in the same direction.

For actively decreasing the temperature, the metal cooling liquid 2 passes after the first pump 51 through a heat exchanger 7 in which the metal cooling liquid 2 can be cooled to the minimum operating temperature. To this end, the heat exchanger 7 is set to a cooling mode by the control unit 8 when a fixed temperature has been reached (e.g., from 270° C. for tin). The heat exchanger 7 is a component part of a secondary cooling circuit 9, not described more fully, and can be based on a variety of cooling principles. Depending on the waste heat occurring during plasma generation, the metal cooling liquid 2 can be cooled specifically and efficiently via the secondary cooling circuit 9 connected to the heat exchanger 7. Spray cooling, shown schematically in FIG. 4, is particularly advantageous for this purpose, wherein a coolant 91 of the secondary cooling circuit 9 impinges on a dividing wall 71 of the heat exchanger 7 past which the metal cooling liquid 2 flows on the side of the cooling circuit 1. However, other liquid cooling, air cooling, heat-pipe cooling or chemical coolants can also be used.

After cooling through the heat exchanger 7, the metal cooling liquid 2 is returned to the immersion bath 3 for cooling the revolving element 31.

The adjustment of the flow rate of pumps 51 and 61 as well as the triggering of the heating mode or cooling mode is carried out through the control unit 8 based on the temperatures monitored at a plurality of locations in the cooling circuit 1. For this purpose, further temperature sensors 84 can be arranged at the immersion bath 3 and at the return 46 in addition to those described above.

In addition to monitoring the temperature, the control unit 8 in this embodiment example has a flow sensor 85 for monitoring the flow rate which can detect the flow velocity of the metal cooling liquid 2 in the pipeline 11. The flow sensor 85 is arranged in front of the inlet 34 to the immersion bath 3.

For an efficient cooling mode, the secondary cooling circuit 9 has a further heat exchanger 7 which is arranged at the vessel bottom of the reservoir 4. The temperature of the metal cooling liquid 2 can be decreased already in the reservoir 4 and upstream of pumps 51 and 61 by this heat exchanger 7.

In a further embodiment, the pumping unit 5 has, in addition to the first pump 51 and the second pump 61, further first pumps 52, 53, . . . and further second pumps 62, 63, etc. These first and second pumps 51, 61; 52, 62; 53, 63; . . . can be arranged in parallel or in series with one another depending on the construction and difference in height of the pipeline 11.

In an arrangement of individual further first pumps 52, 53, . . . , the latter are arranged at respective parallel pipe portions 12 which are connected to the removal orifice 41 at the reservoir 4. Each of the further first pumps 52, 53, . . . is then operated corresponding to the first embodiment example, wherein either an immersion bath 3 with increased flow rate or a plurality of immersion baths 3 with identical flow rate can be operated in parallel with this arrangement.

Figure 5:
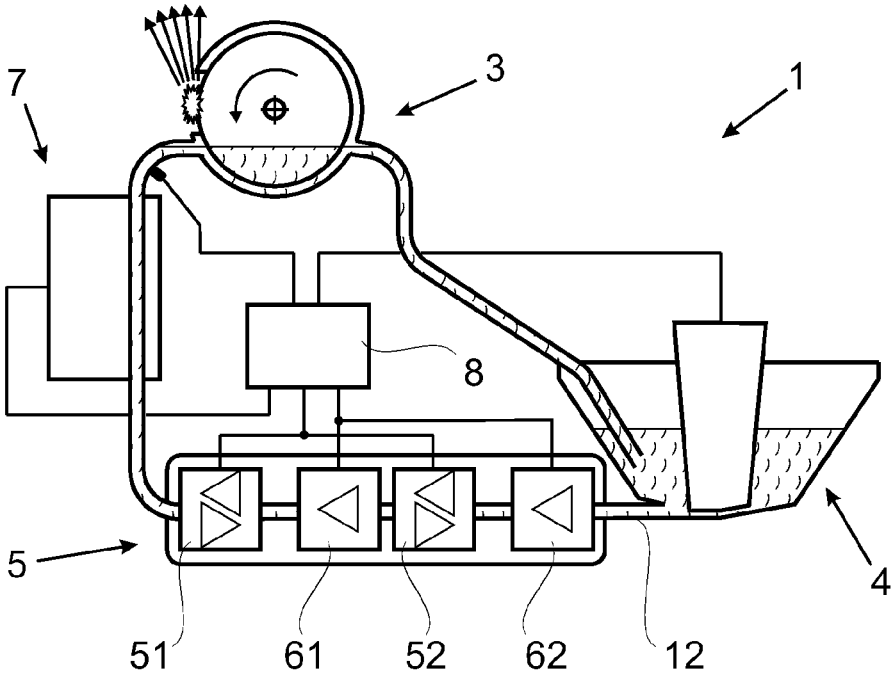
FIG. 5 is an embodiment example of a cooling circuit with further pumps arranged in series.
Figure 6:
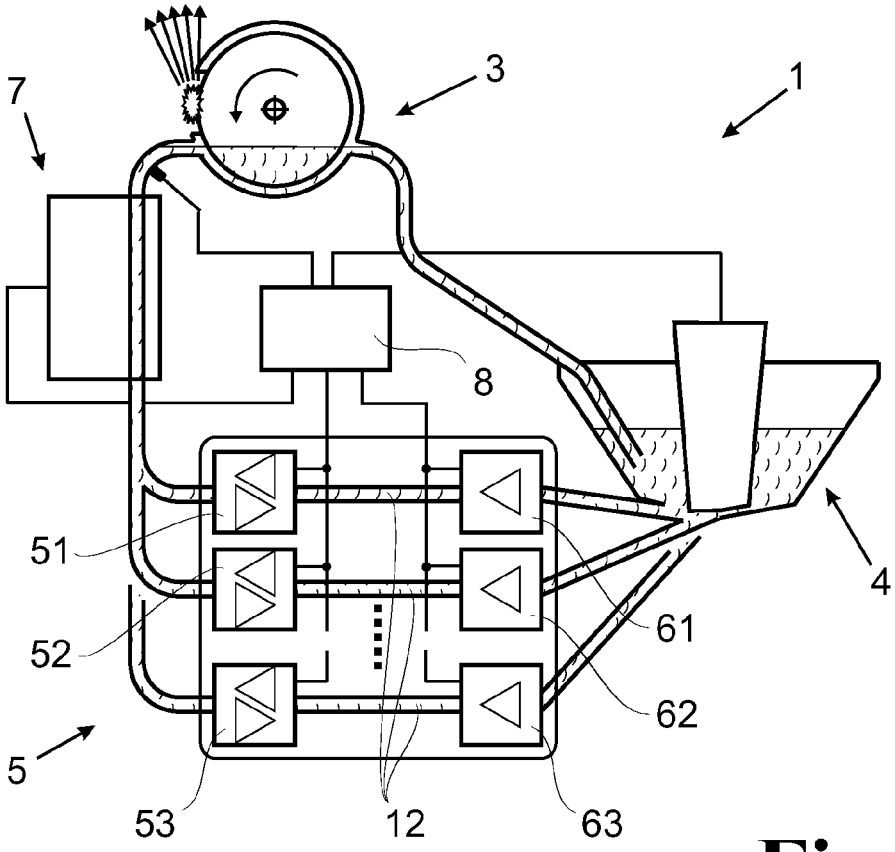
FIG. 6 is an embodiment example of a cooling circuit with further pumps arranged in parallel.

When further first and second pumps 52 and 62, 53 and 63, . . . are arranged in pairs as is shown in FIG. 5 and FIG. 6, first and second pumps 51, 61; 52, 62; 53, 63; etc. which are identically constructed in each instance are used for each pump pair. The total quantity of further first and second pumps 52 and 62, 53 and 63, . . . should always give an even number so that the further first and second pumps 52 and 62, 53 and 63, . . . can be arranged in pairs in each instance for operating in opposite directions. The further first and second pumps 52 and 62, 53 and 63, . . . can be arranged pairwise in series as is shown schematically in FIG. 5 or pairwise in parallel as is shown by way of example in FIG. 6.

When arranged in series, e.g., during continuous conveying during plasma generation, greater differences in height between reservoir 4 and immersion bath 3 can be overcome and/or longer pipe portions 12 can be heated in the heating mode, wherein individual pumps can also be switched off after heating if necessary.

With a pairwise arrangement in parallel, the flow rate can be divided among the total quantity of pumps so that individual pump pairs can be operated with lower flow rate. In both cases, it is accordingly possible to use smaller pumps with smaller capacity. In contrast to the first embodiment example, the flow rate which is low at first and then increases gradually can also be achieved in parallel operation with the first pump 51 and second pump 61 and further first pumps 52, 53, . . . and further second pumps 62, 63, . . . arranged in pairs when the first pumps 51, 52 further operate in direction opposite to the second pumps 61, 62, . . . To this end, with the first and second pumps 51 and 61 and further first and second pumps 52 and 62, . . . arranged in pairs, the flow rate of the first pumps 51, 52, . . . directed against the conveying direction of the cooling circuit 1 is gradually decreased in each instance. A resulting difference relative to the flow rate of the second pumps 61, 62, . . . operated in the conveying direction of the cooling circuit 1 can be varied in a suitable manner. By varying this difference, the liquid level of the metal cooling liquid 2 in the pipeline 11 leading to the immersion bath 3 can be raised in a controlled manner and the pipeline 11 can be heated. The eddy current losses occurring in the oppositely pumped part of the metal cooling liquid 2 further contribute to the heating of the metal cooling liquid 2 during the gradual heating of the cooling circuit 1. When the cooling circuit 1 is completely heated, the first pumps 51, 52, . . . are operated in the same pumping direction again and, together with the second pumps 61, 62, . . . , the desired flow rate is adjusted. It is also possible to switch off individual pumps or pump pairs in case only a slight cooling of the revolving element 31 is needed.

Of course, it is also possible to combine the various types of pump arrangements with one another.

In a further embodiment, the secondary cooling circuit 9 of the heat exchanger 7 can be used to heat the metal cooling liquid 2 in the cooling circuit 1. To this end, the secondary cooling circuit 9 has a heater by which the secondary coolant 91 is heated to temperatures above the melting temperature of the metal of the metal cooling liquid 2. By introducing the secondary coolant 91 into the heat exchanger 7, the heat exchanger 7 as well as the metal cooling liquid 2 of the cooling circuit 1 flowing through the heat exchanger 7 can be heated. The optimal operating temperature is reached faster in the cooling circuit 1 in the third method step as a result of the additional heating.

Figure 7:
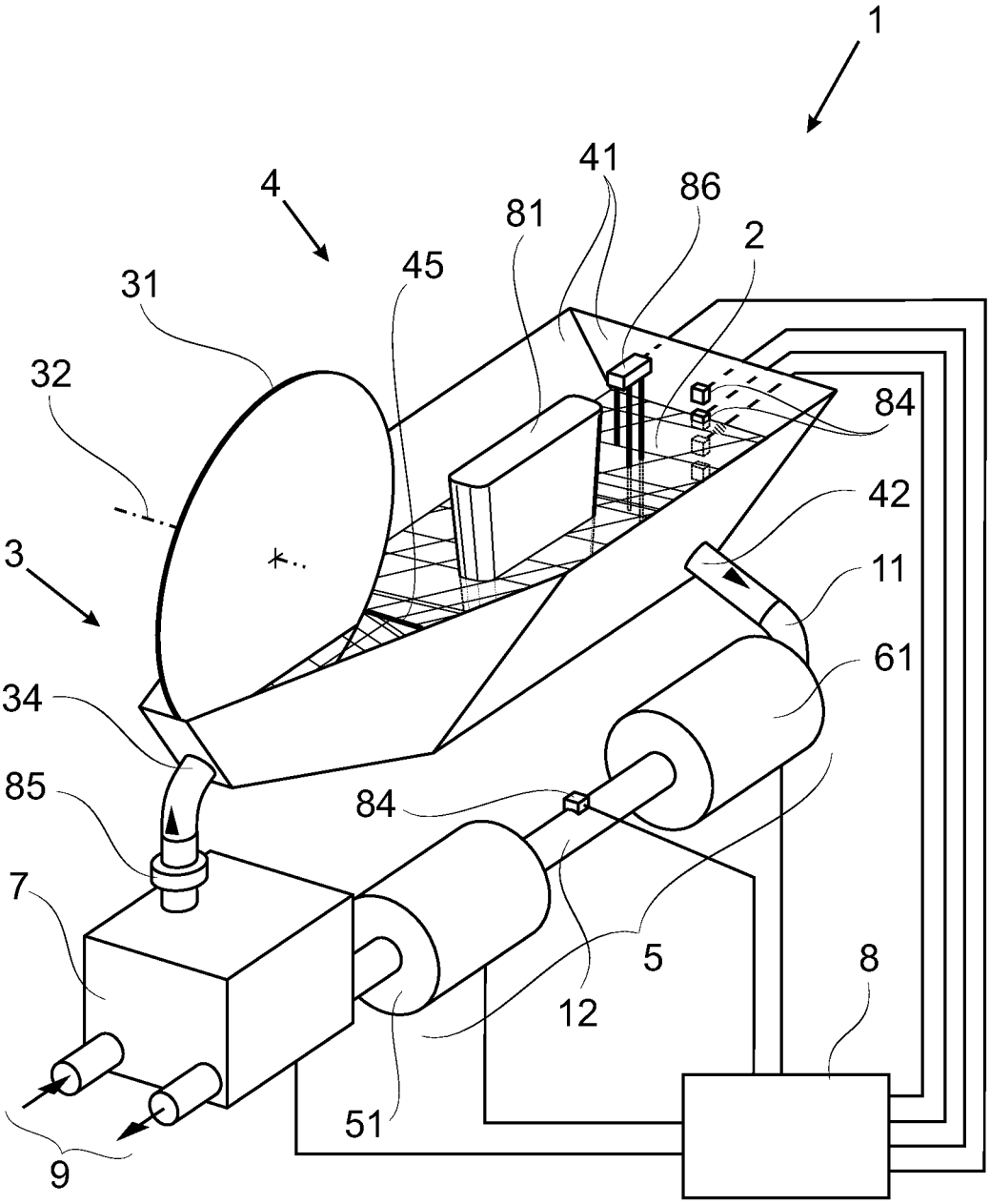
FIG. 7 is a further embodiment example of a cooling circuit of a plasma-based radiation source with a combined immersion bath and reservoir.

In another, appreciably modified arrangement shown in FIG. 7, the cooling circuit 1 of the plasma-based radiation source is accommodated in a common vessel which contains the immersion bath 3 as well as reservoir 4. The pipeline 11 at which pumps 51 and 61 are located for heating and circulation of the cooling circuit 1 is guided from a lower removal orifice 42 at the reservoir 4 to the higher immersion bath 3 of the common vessel. The revolving element 31 of the radiation source is partially immersed in the immersion bath 3. An intermediate wall 45 which forms an overflow determining the fill level and forms the return 46 to the reservoir 4 is used in the common vessel between the immersion bath 3 and the reservoir 4.

LIST OF REFERENCE NUMERALS

1 cooling circuit
11 pipeline
12 pipe portion
2 metal cooling liquid
3 immersion bath
31 revolving element
32 axis of rotation
33 outlet
34 inlet
4 reservoir
41 vessel wall
42 removal orifice
43 minimum fill level
44 maximum fill level
45 intermediate wall
46 return
5 pump unit
51 first pump
52, 53, . . . further first pumps
61 second pump
62, 63, . . . further second pumps
7 heat exchanger
71 dividing wall
8 control unit
81 heater
82 heating circuit
82.1 first heating circuit
82.2 final heating circuit
83 further heater
84 temperature sensor
85 flow sensor
86 fill level sensor
9 secondary cooling circuit
91 coolant

What is claimed is:

1. An arrangement for cooling a plasma-based radiation source with a metal cooling liquid comprising:

a revolving element to be cooled;

an immersion bath comprising the metal cooling liquid in which the revolving element is at least partially immersed;

a cooling circuit coupled to the immersion bath and comprising a reservoir for receiving a minimum volume of the metal cooling liquid;

means for maintaining the metal cooling liquid above a melting temperature, and at least one temperature sensor for monitoring a temperature of the metal cooling liquid; and a pump unit for circulating the metal cooling liquid in the cooling circuit from the reservoir to the immersion bath, the pump unit being arranged in a pipe portion connected to the reservoir in a conveying direction of the cooling circuit, the pump unit comprising at least one pump in the pipe portion for conveying the metal cooling liquid through an external electromagnetic field of the at least one pump, and in that a control unit is provided for controlling the at least one pump, the control unit operating the at least one pump at least temporarily in a pumping direction opposite to the conveying direction of the cooling circuit for generating a heating effect in the metal cooling liquid located in the pipe portion against a flow resistance of the metal cooling liquid in the pipe portion affected by the external electromagnetic field.

2. The arrangement according to claim 1, wherein the at least one pump is arranged at the pipe portion of the cooling circuit, the pipe portion being disposed below a minimum fill level predetermined by a minimum volume of the metal cooling liquid in the reservoir.

3. The arrangement according to claim 1, wherein the flow resistance of the metal cooling liquid in the pipe portion is generated by the metal cooling liquid stored in the reservoir.

4. The arrangement according to claim 1, wherein the pump unit comprises at least one first pump and at least one second pump, wherein the at least one second pump is disposed in the pipe portion upstream of the at least one first pump from the direction of the reservoir, wherein if more second pumps than the at least one second pump are used, each second pump is disposed upstream of the at least one first pump.

5. The arrangement according to claim 4, wherein the flow resistance in the pipe portion is generated by the at least one second pump operated in the conveying direction when the at least one first pump operates in an opposite direction to the conveying direction of the cooling circuit.

6. The arrangement according to claim 4, further comprising additional first pumps and additional second pumps in the pump unit, the additional first and second pumps being controllable separately by the control unit such that at least all of the first pumps can be operated with pumping in the opposite direction to the conveying direction.

7. The arrangement according to claim 1, all of the pumps in the pump unit are induction pumps.

8. The arrangement according to claim 1, wherein the control unit is provided for monitoring and adjusting an operating temperature of the metal cooling liquid above the melting temperature thereof, wherein the control unit uses at least one temperature sensor provided in the cooling circuit to initiate a heating mode when the temperature drops below an operating temperature of the metal cooling liquid and to initiate a cooling mode when the operating temperature is exceeded.

9. The arrangement according to claim 8, further comprising a heater which can be switched on by the control unit in the heating mode to heat the metal cooling liquid in the reservoir.

10. The arrangement according to claim 9, wherein the heater is arranged in the reservoir in such a way that when the heater is dipped into the reservoir, the heater melts the metal cooling liquid from top to bottom.

11. The arrangement according to claim 10, wherein the heater is divided into separate heating circuits which can be controlled separately for melting the metal cooling liquid in the reservoir by layers from top to bottom.

12. The arrangement according to claim 11, further comprising an additional heater for the immersion bath.

13. The arrangement according to claim 8, further comprising at least one heat exchanger arranged upstream of the immersion bath and switchable by means of the control unit in the cooling mode for cooling the metal cooling liquid to a temperatures below a determined maximum operating temperature of the metal cooling liquid, the heat exchanger is controllable to maintain a determined minimum operating temperature above the melting temperature of the metal cooling liquid during cooling.

14. The arrangement according to claim 13, wherein the heat exchanger can be switched on as a heater when the temperature of the metal cooling liquid is below the melting temperature or approaching below the determined minimum operating temperature, wherein the heat exchanger comprises a secondary cooling circuit with a coolant which has a minimum temperature above the melting temperature of the metal cooling liquid.

15. A method for cooling a plasma-based radiation source with a metal cooling liquid, the method comprising:

heating the metal cooling liquid solidified in a reservoir of a cooling circuit with a heater starting from a maximum fill level of the metal cooling liquid in a direction to a deepest point of the reservoir, thereby melting the metal cooling liquid;

melting the metal cooling liquid solidified in a pipe portion connected to the reservoir by means of an external electromagnetic field of at least one pump which is arranged in the pipe portion and which is temporarily operated during the melting in a pumping direction opposite to a predefined conveying direction of the cooling circuit; and heating the entire cooling circuit to an operating temperature above a melting temperature of the metal cooling liquid by switching the at least one pump to the predefined conveying direction of the cooling circuit, therefore conveying the metal cooling liquid out of the reservoir into the cooling circuit by means of the at least one pump arranged in the pipe portion.

16. The method according to claim 15, further comprising adjusting the at least one pump temporarily operated opposite to the conveying direction of the cooling circuit to a maximum flow rate in the conveying direction of the cooling circuit.

17. The method according to claim 15, wherein carrying out switching of the at least one pump from a pumping direction temporarily directed opposite to the conveying direction to the conveying direction of the cooling circuit occurs when a required operating temperature of 5-70 K above the melting temperature of the metal cooling liquid is reached in the pipe portion connected to the reservoir.

18. The method according to claim 17, wherein adjusting the at least one pump after switching from temporarily operating opposite to the conveying direction to cooling operation in the conveying direction is carried out to a minimum flow rate at which a predetermined operating temperature of the metal cooling liquid in the cooling circuit is achieved.

19. The method according to claim 15, further comprising pumping the at least one pump operated opposite to the conveying direction against at least one second pump operated in the conveying direction to melt the metal cooling liquid solidified in the pipe portion connected to the reservoir, wherein the at least one second pump is adjusted to operate at a maximum flow rate during melting of the solidified metal cooling liquid.

20. The method according to claim 19, further comprising readjusting the at least one second pump operated in the conveying direction of the cooling circuit from the maximum flow rate to a minimum flow rate at which a predetermined operating temperature of the metal cooling liquid in the cooling circuit is achieved simultaneously with switching the at least one first pump into the conveying direction of the cooling circuit.

* * * * *